US009869326B2

(12) United States Patent
Stark et al.

(10) Patent No.: US 9,869,326 B2
(45) Date of Patent: Jan. 16, 2018

(54) CENTRIFUGAL PUMP IN PARTICULAR FOR WASTE WATER OR POLLUTED WATER

(71) Applicant: WILO SE, Dortmund (DE)

(72) Inventors: Holger Stark, Dortmund (DE); Alfred J. Otto, Oberkotzau (DE); Wolfgang Geier, Hof (DE); Bernd Kretschmer, Hof (DE); Wolfgang Stroessner, Gattendorf (DE)

(73) Assignee: WILO SE, Dortmund (DE)

( * ) Notice: Subject to any disclaimer, the term of this patent is extended or adjusted under 35 U.S.C. 154(b) by 287 days.

(21) Appl. No.: 14/646,305

(22) PCT Filed: Dec. 2, 2013

(86) PCT No.: PCT/EP2013/003626
§ 371 (c)(1),
(2) Date: May 20, 2015

(87) PCT Pub. No.: WO2014/086472
PCT Pub. Date: Jun. 12, 2014

(65) Prior Publication Data

US 2015/0292519 A1 Oct. 15, 2015

(30) Foreign Application Priority Data

Dec. 5, 2012 (DE) ..... 10 2012 023 734

(51) Int. Cl.
*F04D 15/00* (2006.01)
*F04D 29/46* (2006.01)
(Continued)

(52) U.S. Cl.
CPC ..... *F04D 29/466* (2013.01); *F04D 1/00* (2013.01); *F04D 7/02* (2013.01); *F04D 7/04* (2013.01);
(Continued)

(58) Field of Classification Search
CPC . F04D 29/466; F04D 7/02; F04D 7/04; F04D 7/045; F04D 13/08; F04D 15/0033;
(Continued)

(56) References Cited

U.S. PATENT DOCUMENTS 6,139,260 A * 10/2000 Arbeus ..... F04D 7/04 415/121.2
6,390,768 B1 * 5/2002 Muhs ..... F04D 7/045 415/196
(Continued)

FOREIGN PATENT DOCUMENTS

CN 201401341 Y 2/2010
DE 7212196 U 3/1972
(Continued)

*Primary Examiner* — Woody Lee, Jr.
*Assistant Examiner* — Sabbir Hasan
(74) *Attorney, Agent, or Firm* — Andrew Wilford

(57) ABSTRACT

The invention relates to a centrifugal pump, in particular a waste water submersible pump having an impeller (1), of which the end face facing the pump intake opening is open and only the end face of the impeller facing away from the intake opening (8) is covered by a circular coaxial impeller hub (2), on which the curved vanes (3, 4) are fastened, and in particular molded on, wherein the base plate (7) having the intake opening (8) facing the impeller (1) or at least one segment (7*a*) of the base plate is mounted so as to be movable against spring pressure (20) in such a way that the distance thereof from the impeller (1) and thus from the impeller vanes (3, 4) changes.

11 Claims, 7 Drawing Sheets

(51) Int. Cl.

| | |
|---|---|
| ***F04D 7/04*** | (2006.01) |
| ***F04D 13/08*** | (2006.01) |
| ***F04D 29/62*** | (2006.01) |
| ***F04D 29/70*** | (2006.01) |
| ***F04D 1/00*** | (2006.01) |
| ***F04D 7/02*** | (2006.01) |
| ***F04D 29/30*** | (2006.01) |
| ***F04D 29/42*** | (2006.01) |

(52) U.S. Cl.
CPC ..... *F04D 13/08* (2013.01); *F04D 15/0033* (2013.01); *F04D 29/30* (2013.01); *F04D 29/426* (2013.01); *F04D 29/622* (2013.01); *F04D 29/708* (2013.01)

(58) Field of Classification Search
CPC ..... F04D 29/30; F04D 29/242; F04D 29/622; F04D 29/4286
See application file for complete search history.

(56) References Cited

U.S. PATENT DOCUMENTS

| | | | | |
|---|---|---|---|---|
| 6,951,445 | B2 * | 10/2005 | Burgess | F04D 29/2288 415/121.1 |
| 8,608,428 | B2 | 12/2013 | Andersson | |
| 2004/0146416 | A1 | 7/2004 | Burgess | |

FOREIGN PATENT DOCUMENTS

| | | | |
|---|---|---|---|
| DE | 4142120 | A | 6/1993 |
| DE | 19823603 | A | 12/1999 |
| DE | 102005056200 | A | 6/2007 |
| DE | 102010026176 | A | 1/2012 |
| EP | 1538338 | A | 12/2003 |
| EP | 1906025 | A | 4/2008 |
| EP | 1906026 | A | 4/2008 |
| FR | 2681906 | A | 4/1993 |
| FR | 2681906 | A1 * | 4/1993 |
| WO | 00197033091 | A1 | 9/1997 |
| WO | 2003081050 | A | 10/2003 |

* cited by examiner

CENTRIFUGAL PUMP IN PARTICULAR FOR WASTE WATER OR POLLUTED WATER

CROSS REFERENCE TO RELATED APPLICATIONS

This application is the US-national stage of PCT application PCT/EP2013/003626 filed 2 Dec. 2013 and claiming the priority of German patent application 102012023734.0 itself filed 5 Dec. 2012.

FIELD OF THE INVENTION

The invention relates to a centrifugal pump, in particular a sewage or waste-water motor pump having an impeller whose end face turned toward the pump intake is open and only the impeller end face opposite the intake is covered by a circular coaxial support disk on which curved vanes are fixed and particularly integrally formed.

BACKGROUND OF THE INVENTION

Sewage often contains coarse solids such as long-fiber admixtures that can clog a centrifugal pump. To reduce this risk of clogging, it is known to provide a large gap between the base plate having the intake and the impeller, so that larger solid particles flow laterally past the impeller without blocking it. The efficiency of such a non-clogging centrifugal pump is thereby substantially reduced.

OBJECT OF THE INVENTION

The object of the present invention is to improve a centrifugal pump of the above-described type such that a high operational reliability and a low risk of clogging exist at high pumping efficiency.

SUMMARY OF THE INVENTION

This object is achieved according to the invention in that the base plate turned radially inward toward the impeller and having a intake, or at least a segment thereof, is movably adjustable and/or deformable and/or movable against spring pressure such that it varies its spacing from the impeller and thus from the impeller vanes.

Such a construction makes it possible for the gap between impeller and base plate to adapt automatically to the degree of soiling and to the size of the conveyed solids and/or can be accordingly optimally adapted by adjustment.

It is proposed for this purpose that the base plate and/or the segment(s) of the base plate are mounted on the pump housing by at least one screw. A particularly simple and sturdy construction is provided when the screw(s) penetrate/penetrates the base plate and their heads rest in a widened part of the bore that opens toward the impeller.

It is preferably proposed that the screw(s) is/are surrounded by a helical compression spring that generates/generate the spring pressure on the base plate.

An advantageous construction with optimal movability and adaptability to the degree of soiling is obtained if the base plate has a first region movable or fixed relative to the pump housing and at least one plate-shaped region movable against the first region and/or against the housing wall against spring pressure. Here, the movable second region can be held by at least one screw with limited movement against the fixed region and/or against the housing wall.

It is preferably proposed that the gap between the vanes and the base plate increases from the leading edge of the vane to the trailing edge of the vane. It is advantageous if the gap between the vanes and the base plate is 0.5 to 2 mm. The impeller preferably has two of the curved vanes.

An advantageous embodiment is that the base plate is trough-shaped, in particular concavely curved on its side turned radially inward toward the impeller, and the axial height of the vanes decreases radially outward complementarily to the base plate curvature.

A low-vibration, straight-line input flow is achieved if the intake has flow grooves in its inner wall that preferably extend parallel to the primary flow direction in the intake. It is preferably proposed here that the inner wall of the intake is cylindrical and the flow grooves extend parallel to the axis of the cylinder inner wall.

It is particularly advantageous,

- if the base plate of the pump housing having the intake over which the free edges of the vanes extend a slight distance has at least one, preferably two, three or more in particular C-shaped curved grooves,
- if the grooves extend from the suction and to the outer edge of the base plate, and
- if the grooves are curved opposite to the curvature of the vanes.

These curves formed in the base plate improve the transport of solids radially outward and thus greatly reduce the risk of clogging of the pump.

It is preferably proposed that from the two side walls of the grooves, those side walls that were last traversed by a vane form an inclined surface that extends from the groove outward.

BRIEF DESCRIPTION OF THE DRAWING

Several embodiments are shown in perspective and sectional views in the drawings and are described in more detail below.

SPECIFIC DESCRIPTION OF THE INVENTION

Figure 1:
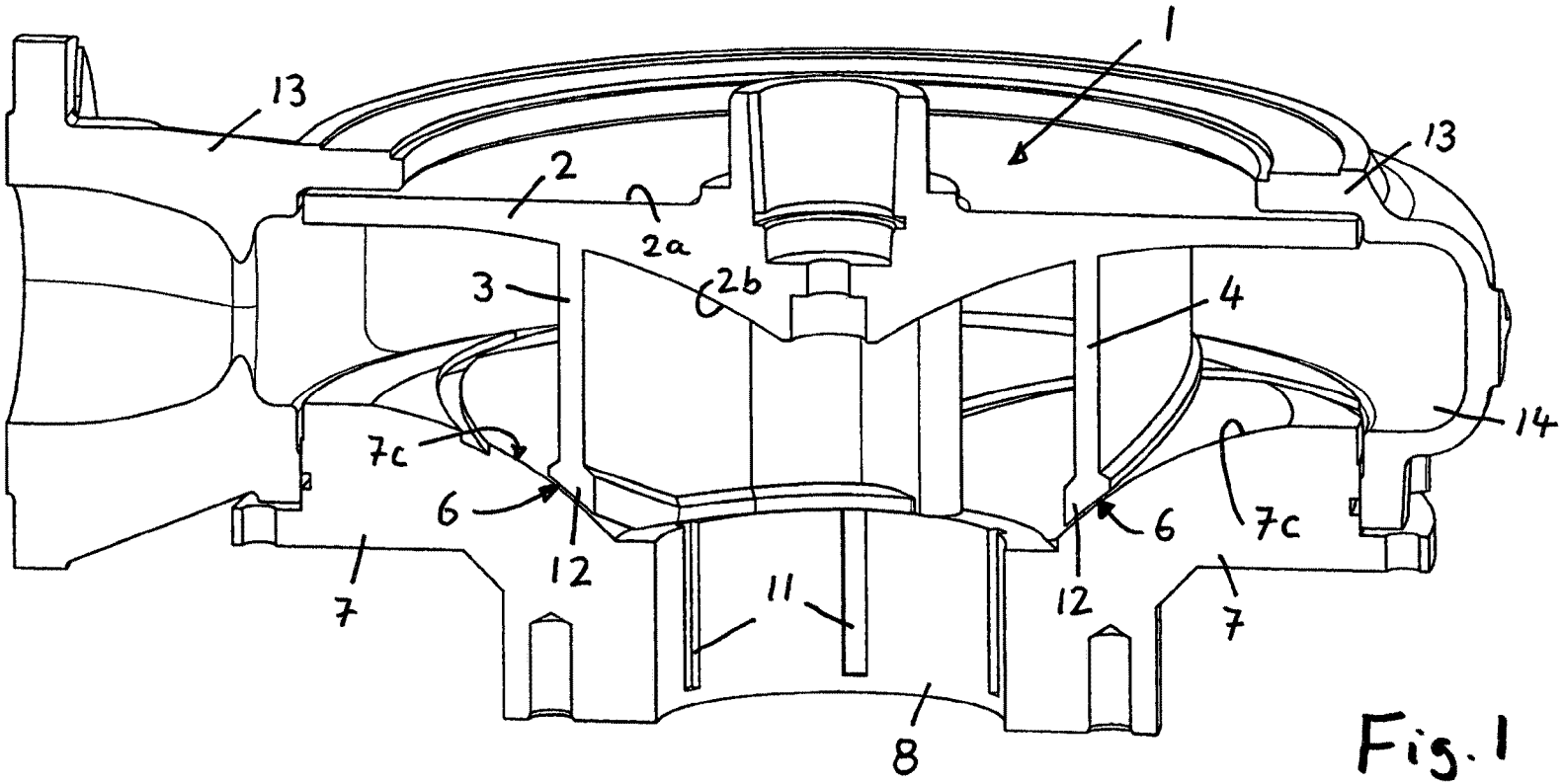
FIG. 1 is a perspective view of an axial section through a centrifugal pump.

The centrifugal pump according to the invention is particularly suitable for pumping sewage and waste water containing solid particles. It is preferably part of a submersible water pump.

The pump impeller 1 is driven by the shaft of an unillustrated electric motor and is in a pumping chamber between an axially centered intake 8 in a base plate 7 and a wall that separates the electric motor from the pumping chamber. The impeller 1, made of plastic or metal, draws the pumped medium in axially through the intake 8 and expels it radially to a helical channel 14 formed by a pump housing 13 surrounding the impeller 1 and emptying at a pump output. The base plate 7 is concave on its side turned axially inward toward the impeller 1, in particular concavely curved, and the height of vanes 3 and 4 of the pump decreases outwardly corresponding to the base-plate curvature.

The impeller 1 is one-sided, i.e. it has a circular support disk (cover plate) 2 on the back turned toward a rim of the housing 13 and has no front cover plate. On the front face turned toward the intake 8, the support disk 2 carries the two vanes 3 and 4 that are curved (in particular C-shaped), and the concave side of each vane 3 and 4 is directed radially inward toward the unillustrated impeller shaft. Instead of two vanes, one, three or more vanes can also be fixed, in particular integrally formed on the support disk 2.

The approximately C-shaped curved vanes 3 and 4 extend from the inside outward to the outer edge of the impeller 1, and the generatrix of the vane extends parallel or at an acute angle to the pump axis and thus to the impeller shaft, so that each vane is at a right or acute angle to a planar rear face 2*a* of the support disk 2 on front face 2*b* of the support disk that rises toward the middle of the disk. The free outer edge of each vane 3 and 4 forms an elongated region 12 of increased thickness that extends as a profile along the vane edge in the embodiment according to FIG. 1 where the profile has a triangular, rectangular or polygonal cross-section with an inclined longitudinal surface 6 turned toward the inner face 7*c* of the base plate 7 and that is angled parallel to the surface 7*c*. Here, the spacing between the longitudinal surface or chamfer 6 and the surface 7*c* is preferably 0.5 to 2 mm. Here also, the spacing between the vanes 3 and 4 and the base plate 7 can increase from the leading edge of the vane to the trailing edge of the vane.

In embodiments not shown, the thick region 12 is not formed with a profile with a cross-section that remains uniform across its length, but rather the thick region 12 is either only partially, in particular in sections, profile-shaped or its cross-section increases or decreases in size from one end to the other. In all embodiments, the largest cross-section of the elongated region 12 of increased thickness is always greater than the width and thickness D of the vane 3 and 4. Here, the region 12 of increased thickness projects on both or at least one side of the vane.

Figure 2:
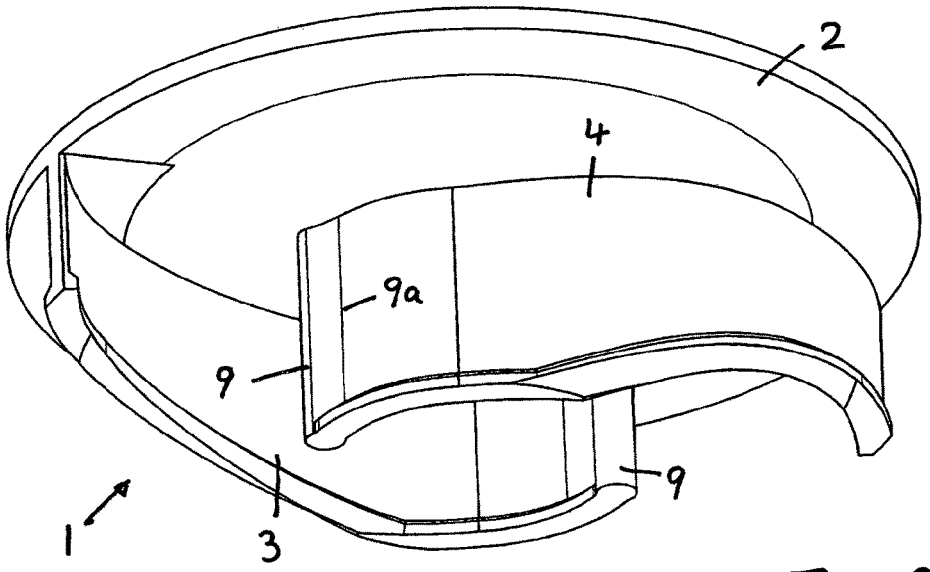
FIG. 2 is a view of the pump impeller.

An inner end 9*a* of each vane 3 and 4 shown in FIG. 2 forms the leading edge of the vane 3 of 4 carries an elongated, in particular integrally formed region 9 of increased thickness that runs along the inner vane edge and is parallel to the impeller shaft in the embodiment shown in FIG. 2. At least one of the regions of increased thickness can however also be disposed at an acute angle to the impeller shaft.

In this embodiment, both regions of increased thickness 9 are formed with profiles with a circular cross-section. The profile may however also have differently-shaped cross-sections instead, in particular oval or elliptical. Furthermore, the cross-section can change in shape and/or size along its length, in particular in sections. In all embodiments of the elongated regions of increased thickness 9 and 12, these are preferably of the material of the vane and thus of the same plastic or metal as the vane, and are preferably unitarily formed therewith.

The gap between the base plate 7 and the vanes 3 and 4 is adjustable such that the pump is adaptable to the various admixtures in the sewage or waste water. Either the entire base plate is axially adjustable, or at least the region juxtaposed with the vanes. The adjustment is carried out, for example, by hand by screwthreads, screws 16 or wedge surfaces, in particular with tools, but also by a hydraulic or pneumatic actuator, in particular computer- and/or remote-controlled.

Figure 5:
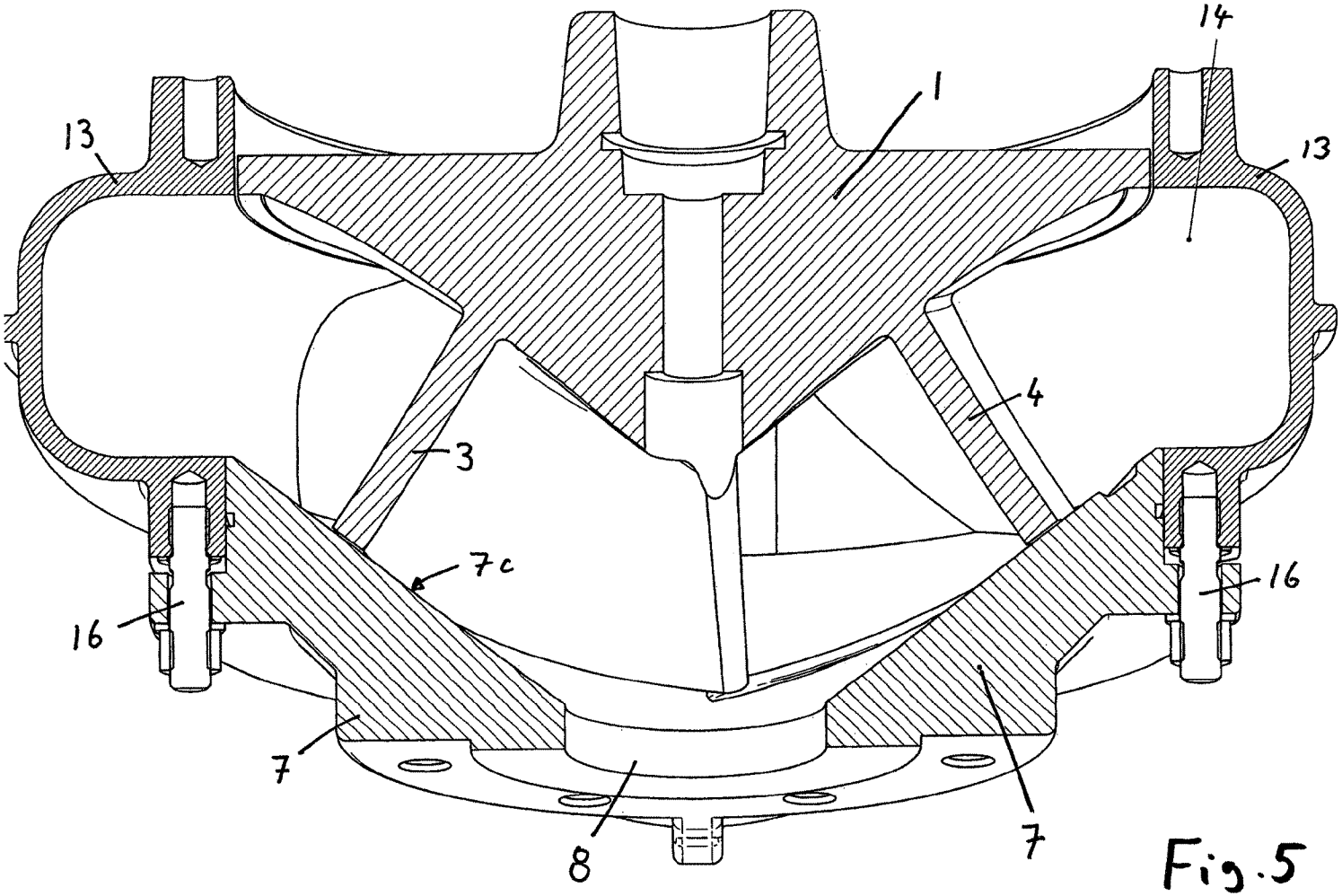
FIG. 5 is an axial section through a centrifugal pump with an externally adjustable base plate.

In the embodiment according to FIG. 5, the base plate 7 is fixed to the pump housing 13 by screws 16 at the outer edge of the base plate, so that an adjustment of gap between the base plate 7 and the impeller 1 can be carried out from the outside.

Figure 6:
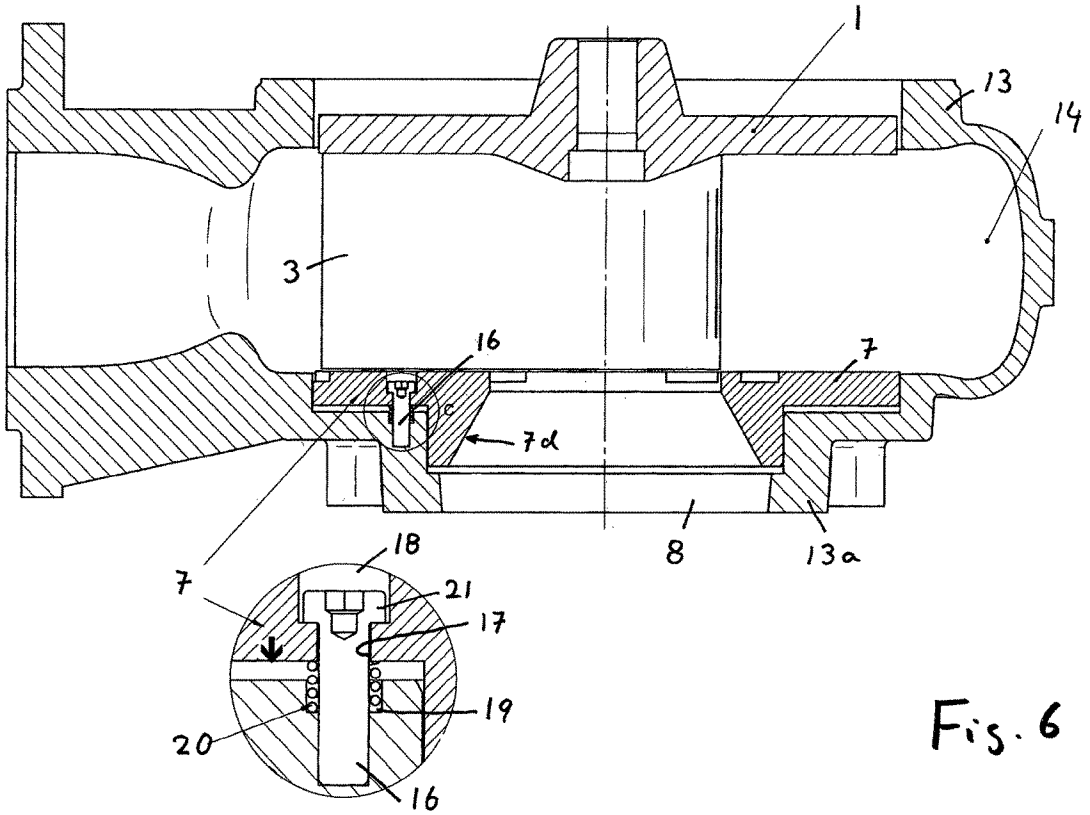
FIG. 6 is an axial section through a centrifugal pump with internally movable mounting of the base plate against spring pressure.

In the embodiment according to FIG. 6, the base plate 7 is inside the pump housing 13, so that it is outwardly covered by the housing wall 13*a*. Here, the base plate 7 has a central opening 7*d* that is aligned with the intake 8 of the housing wall.

The inner base plate 7 is supported by at least one, preferably three or four screws 16 seated in the housing wall and surrounding the intake 8. Here, each screw 16 fits in a bore 17 of the base plate 7. The bore 17 has a counterbore 18 that opens toward the impeller and in which the screw head 21 is engaged. Another bore 19 opening toward the base plate also has a threaded region in the housing wall, and a counterbore of the 19 holds a helical compression spring 20 that bears against the bottom face the base plate 7 in order to push the base plate toward the impeller 1. Since there is a gap of several millimeters between the underside of the base plate 7 and the inside of the housing wall, the base plate can move downward (in FIG. 6) out of the way when a large solid particle passes between the base plate and the outer edges of the impeller vanes.

Figure 7:
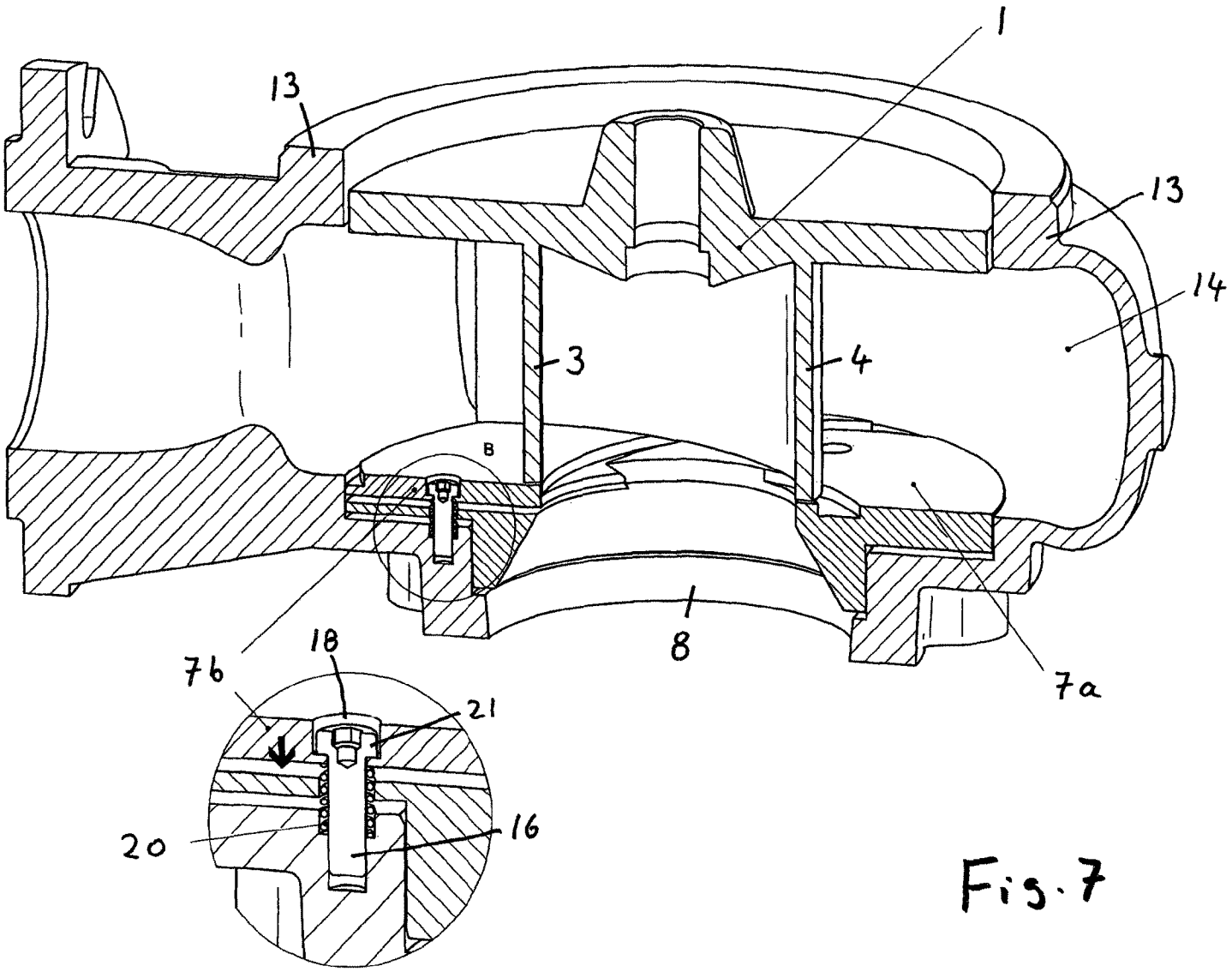
FIG. 7 is a perspective view of an axial section through a centrifugal pump with a movable segment of the base plate.
Figure 8:
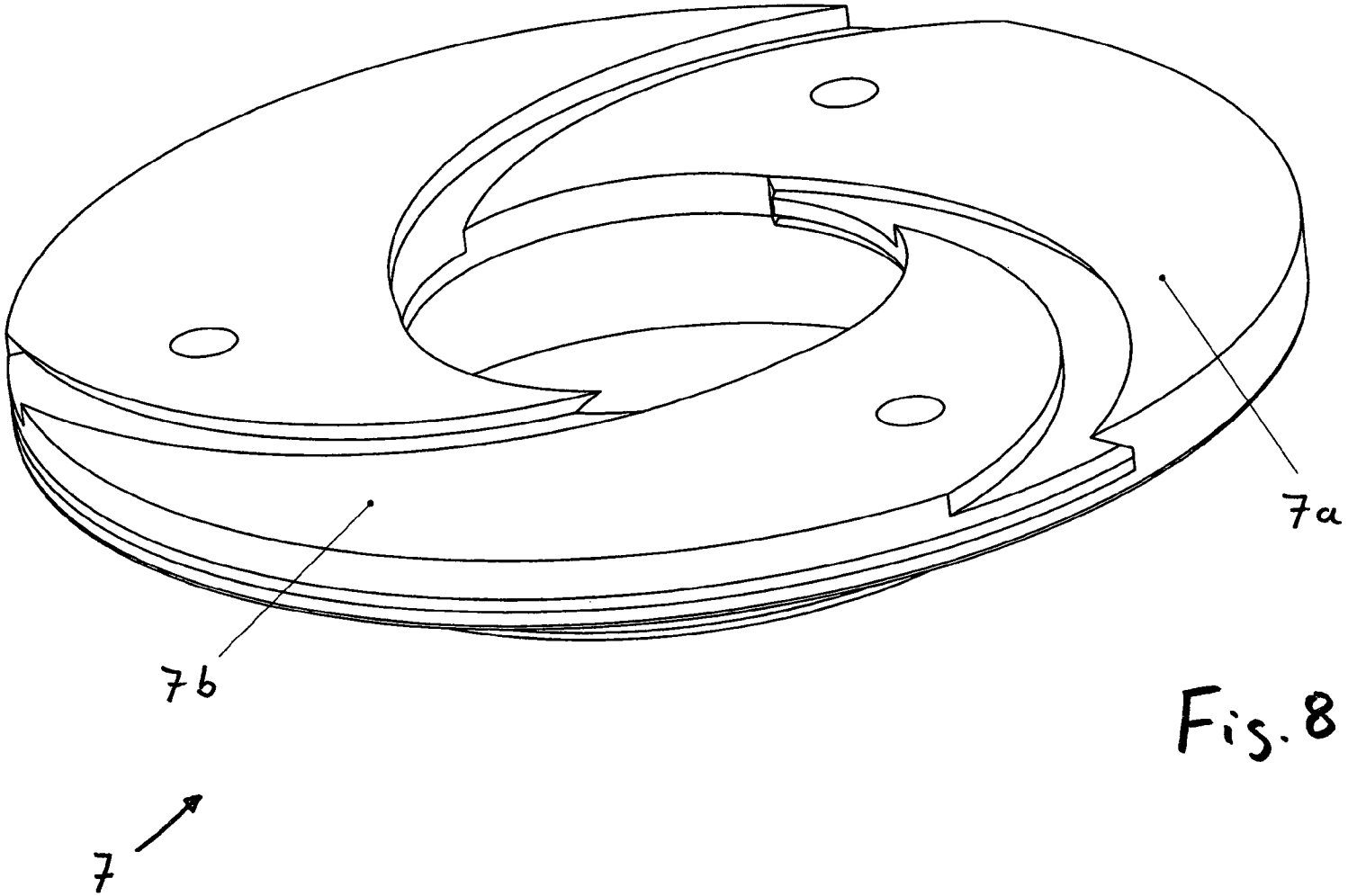
FIG. 8 shows a perspective view of the base plate with a movable region/segment.

The embodiment according to FIG. 7 differs from that of FIG. 6 in that the inner mounted base plate has a first region 7*a* movably or unmovably mounted on the pump housing on which a second, in particular segment 7*b* is movably mounted against spring pressure and/or held movably by elastic deformability of the component. In this embodiment, the head 21 of the screw(s) rests in a counterbore of the second plate-shaped, in particular segment 7*b* such that at least the second region and the segment 7*b* can move out of the way away from the impeller 1 against the pressure of the spring 20 and/or deform when large solid particles pass between the impeller vanes and the plate-shaped segment 7*b*.

Figure 3:
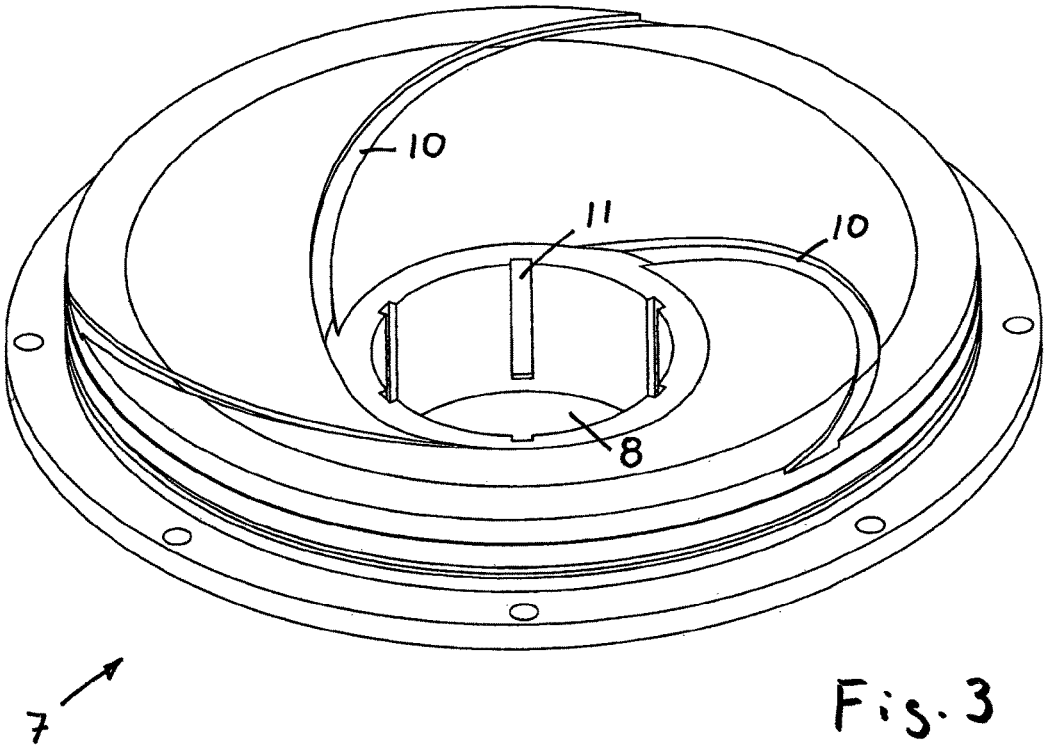
FIG. 3 is a view of the pump base plate.
Figure 4:
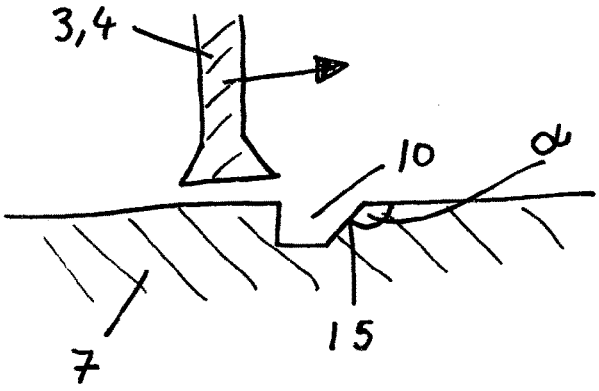
FIG. 4 is a section through a groove in the base plate.

The base plate 7 has, as shown in FIG. 3, three in particular C-shaped curved grooves 10 that extend from the suction port 8 to the outer edge of the base plate 7 and are curved opposite to the curvature of the vanes 3 and 4. The grooves 10 assist in conveying the solids radially outwardly, so that a self-cleaning effect occurs. The outward movement is enhanced in that from the two side walls of the grooves 10, those side walls that were last traversed by a vane 3 and 4 form an inclined surface 15 that extends from the groove outward (see FIG. 4). The inclined surface 15 forms an angle a with the base plate 7 of between 110 and 160°.

Instead of three grooves, one, two, four or more grooves can also be incorporated into the base plate.

The preferably cylindrical intake 8 has in its inner wall flow grooves 11 that preferably extend parallel to the primary flow direction in the intake, so that solids in the sewage or waste water are led away from the impeller and the risk of clogging is reduced. Here, the flow grooves 11 are distributed at equal angular intervals across the inner wall of the intake. In the embodiment according to FIG. 3, six flow grooves 11 are shown. The number may however also be smaller (3 to 5) or also larger (7 to 12).

The invention claimed is:

1. A centrifugal pump comprising:

a pump housing having a base plate forming an intake;

an impeller whose front face turned toward the intake is open and whose opposite impeller-end rear face turned toward the intake is formed by a circular coaxial support disk carrying curved integral vanes, the base plate having a segment is movable relative to the pump housing;

a spring braced between the segment and the pump housing such that a spacing of the segment from the impeller and thus from the impeller vanes is variable; and an adjustment screw limiting movement of the segment relative to the pump housing.

2. The centrifugal pump according to claim 1, wherein the segment is movably adjustable or deformable.

3. The centrifugal pump according to claim 1, wherein the segment is mounted on the pump housing by the adjustment screw.

4. The centrifugal pump according to claim 3, wherein the adjustment screw is screwed into the pump housing, extends through the base plate, and has a head s in a counterbore that opens toward the impeller.

5. The centrifugal pump according to claim 3, wherein the spring is a helical compression spring that surrounds the adjustment screw and that applies a biasing force to the base plate.

6. The centrifugal pump according to claim 1, wherein a spacing between the vanes and the base plate is 0.5 to 2 mm.

7. The centrifugal pump according to claim 1, wherein the base plate is trough-shaped and has a concavely curved side turned inward toward the impeller, and an axial height of the vanes decreases radially outward complementarily to a curvature of the base plate.

8. The centrifugal pump according to claim 1, wherein the intake has an inner wall formed with flow grooves extending parallel to a primary flow direction in the intake.

9. The centrifugal pump according to claim 8, wherein the inner wall of the intake is cylindrical and the flow grooves extend parallel to an axis of the cylinder inner wall.

10. The centrifugal pump according to claim 1, wherein the base plate of the pump housing having the intake over which free edges of the vanes extend a small distance has at least one C-shaped curved groove, the groove extends from the intake and to an outer edge of the base plate, and the groove is curved opposite to a curvature of the vanes.

11. The centrifugal pump according to claim 10, wherein the groove has two side walls of which the side wall that is last traversed by a vane forms an inclined surface that extends from the groove outward.

* * * * *